United States Patent [19]

Cheung et al.

[11] 4,356,144

[45] Oct. 26, 1982

[54] CLOSURE HOLD-DOWN SYSTEM FOR A REACTOR VESSEL

[75] Inventors: Ki C. Cheung, La Jolla; Truman F. Unkle, San Diego; Arnold A. Schwartz, Solana Beach; Raymond J. Hsieh, San Diego, all of Calif.

[73] Assignee: General Atomic Company, San Diego, Calif.

[21] Appl. No.: 52,066

[22] Filed: Jun. 25, 1979

[51] Int. Cl.[3] ..... G21C 13/06

[52] U.S. Cl. ..... 376/203; 376/205; 376/296; 376/394; 52/224

[58] Field of Search ..... 176/38, 87; 376/205, 376/206, 287, 293, 295, 296, 394, 203; 52/224; 220/327, 328

[56] References Cited

U.S. PATENT DOCUMENTS

| | | | |
|---|---|---|---|
| 1,835,963 | 12/1931 | Nevius | 220/378 |
| 2,584,100 | 1/1952 | Uecker | 220/328 |
| 2,890,009 | 6/1959 | Chapellier | 176/87 |
| 2,956,704 | 10/1960 | Boni, Jr. | 220/328 |
| 2,983,659 | 5/1961 | Treshow . | |
| 3,356,580 | 12/1967 | Bell | 176/38 |
| 3,486,978 | 12/1969 | Lacriox et al. | 376/296 |
| 3,514,115 | 5/1970 | Gallo | 176/87 |
| 3,669,303 | 6/1972 | Launay | 176/87 |
| 3,712,851 | 1/1973 | Isberg | 176/87 |
| 4,078,968 | 3/1978 | Golden | 176/38 |
| 4,195,457 | 4/1980 | Kissing et al. | 220/378 |

FOREIGN PATENT DOCUMENTS

| | | |
|---|---|---|
| 39-6748 | 5/1964 | Japan . |
| 6516472 | 7/1966 | Netherlands . |

*Primary Examiner*—Harvey E. Behrend

*Attorney, Agent, or Firm*—Fitch, Even, Tabin, Flannery & Welsh

[57] ABSTRACT

A closure hold-down system for a prestressed concrete reactor vessel is disclosed which employs a concrete plug having an annular liner thereon and adapted to be received within the upper open end of a cavity in the reactor vessel. A prestressed concrete retaining ring is mounted on the reactor vessel concentric to the plug through a plurality of circumferentially spaced prestressed tendons anchored directly to the reactor vessel, and engages the concrete plug so that pressure forces acting on the plug from within the cavity are transmitted directly from the plug to the prestressed retaining ring through a contact surface therebetween. An omega seal is disposed between the closure plug and a cavity liner to prevent escape of fluid pressure from the cavity.

11 Claims, 4 Drawing Figures

CLOSURE HOLD-DOWN SYSTEM FOR A REACTOR VESSEL

The present invention relates generally to closure systems for pressure vessels, and more particularly to a novel closure hold-down system for closing a large penetration or cavity in a prestressed concrete reactor vessel to prevent escape of fluid from the vessel.

It is a conventional practice in high temperature gas cooled nuclear reactor systems to position at least one steam generator generally adjacent the reactor core, both the steam generator and reactor core being housed within a relatively large vessel generally made of prestressed concrete. The steam generator cavity or penetration houses a steam generator through which the heated coolant, such as helium, from the reactor core is passed to create superheated steam which may then be employed to produce work through the creation of other forms of energy. The steam generator cavity or penetration is quite large, often approaching 15–25 feet or greater in diameter, and conventionally has a lining which defines the inner annular boundary of the cavity. The steam generator cavity opens outwardly of the top of the reactor vesel to facilitate servicing of the steam generator. A closure plug is conventionally employed to close the upper open end of the steam generator cavity, the plug frequently supporting a circulator and having some minor penetrations therein.

Prior designs of closure hold-down systems for closing the open ends of steam generator cavities in nuclear reactor vessels have employed bolts, flanges, shear anchors and other heavy steel components to transfer the pressure forces applied to the closure from internally of the steam generator cavity to the reactor vessel. The prior designs are relatively costly and usually require a relatively large diameter cavity or penetration and a correspondingly larger concrete reactor vessel which, in turn, requires a large containment building to house the reactor vessel.

One of the primary objects of the present invention is to provide a novel closure hold-down system for closing a large penetration or cavity in a prestressed concrete reactor vessel.

A more particular object of the present invention is to provide a novel closure hold-down system for closing a large cavity or penetration in a prestressed concrete reactor vessel wherein a concrete plug is adapted to be received within the open end of the cavity and is retained therein by a prestressed concrete retaining ring which is supported on the reactor vessel concentric to the concrete plug and is secured directly to the reactor vessel through a plurality of circumferentially spaced prestressed tendons which pass through the length of the reactor vessel and are anchored at the bottom thereof. The retaining ring engages the plug so that pressure forces acting on the plug from internally of the chamber are transmitted directly to the prestressed concrete ring and associated prestressed tendons.

A feature of the closure hold-down system of the present invention is the provision of an omega seal between the concrete plug and a liner defining the cavity or penetration in the reactor vessel, the omega seal being substantially more reliable and durable than conventional "O" ring and elastomer seals.

An additional feature of the closure hold-down system in accordance with the present invention lies in the provision of a frustoconical contact surface between the closure plug and the retaining ring which is effective in reducing the tensile stress on the concrete plug resulting from pressure induced rotation and thereby reduces the quantity of reinforcing bars required in the retaining ring and plug. The inclined contact surface, coupled with the external pressure on the outer cylindrical surface of the plug, provides the desired compressive prestress forces on the plug.

Further objects and advantages of the present invention, together with the organization and manner of operation thereof, will become apparent from the following detailed description of the invention when taken in conjunction with the accompanying drawings, wherein like reference numerals designate like elements throughout the several views, and wherein.

Figure 1:
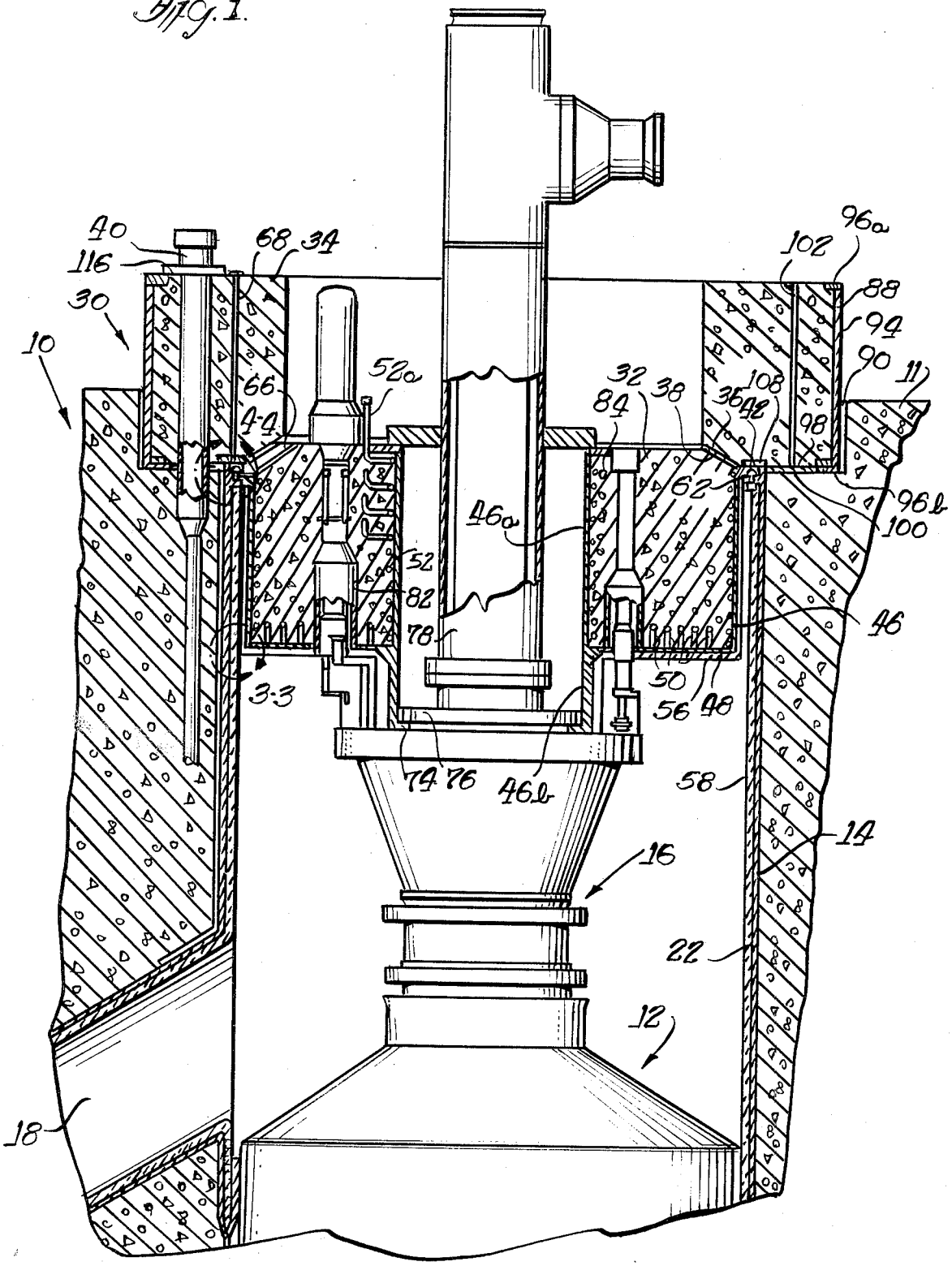
FIG. 1 is a fragmentary view, partly in longitudinal section, of a reactor vessel and associated steam generator employing a closure hold-down system in accordance with the present invention, the view being taken substantially along line 1—1 of FIG. 2, looking in the direction of the arrows.
Figure 2:
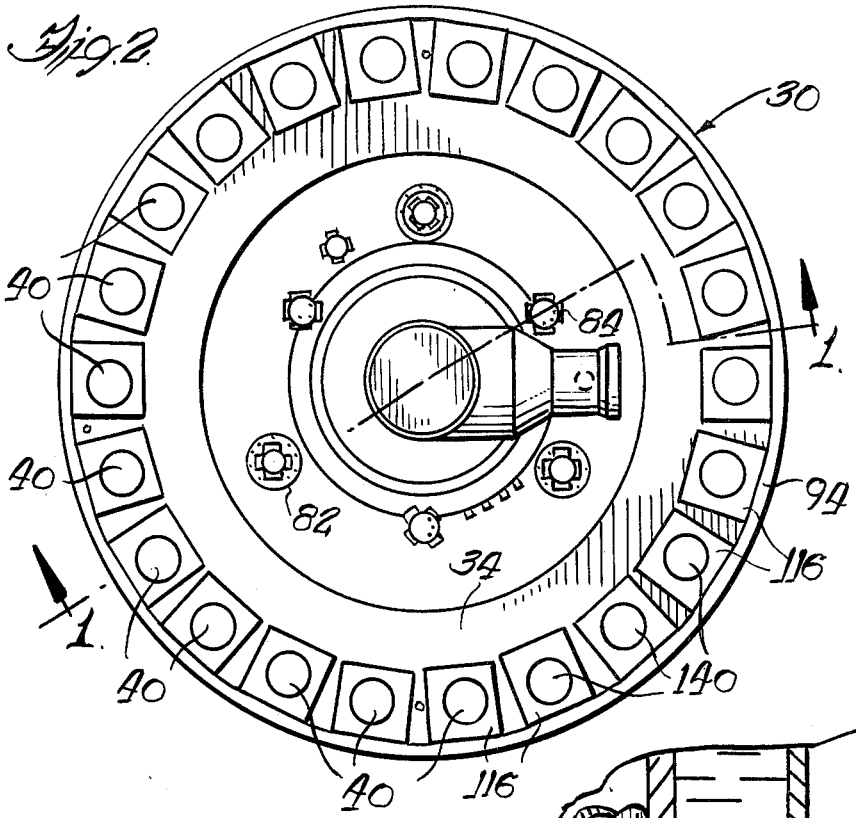
FIG. 2 is a fragmentary plane view of the steam generator cavity closure hold-down system of FIG. 1.

Referring now to the drawings, and in particular to FIG. 1, a closure hold-down system constructed in accordance with the present invention is illustrated, by way of example, in connection with a high temperature gas cooled nuclear reactor vessel, a portion of which is indicated generally at 10. The nuclear reactor vessel 10 comprises a portion of a nuclear reactor system of generally known design wherein the entire primary system including the core, primary coolant circulators, steam generators, and associated main primary coolant ducting is contained within a prestressed concrete reactor vessel 11. Very generally, the concrete reactor vessel 11 illustrated in FIG. 1 houses a steam generator, indicated generally at 12, within a cavity or penetration 14 formed in the reactor vessel and opening outwardly of the upper end of the reactor vessel. It will be appreciated that in conventional nuclear reactors, a reactor core chamber (not shown) is provided within the reactor vessel to house a reactor core. The reactor core chamber and associated reactor core are surrounded by one or more circumferentially spaced chambers or penetrations, such as that indicated at 14 in FIG. 1, each of which is adapted to receive and support a heat exchanger in the form of a steam or vapor generator and an associated coolant circulator such as shown generally at 16 in FIG. 1. The reactor core cooling fluid, which may be a gas which is chemically and nuclearly inert relaive to the system, such as carbon dioxide or helium, is circulated at a relatively high temperature from the reactor core chamber to the steam generator penetration through ducts (not shown) intersecting the heat exchanger penetration generally adjacent its lower end. The coolant is returned to the reactor core chamber for recirculation through the reactor core through a suitable duct, such as indicated at 18, intersecting the penetration 14 adjacent its upper end and communicating with the core chamber.

Figure 4:
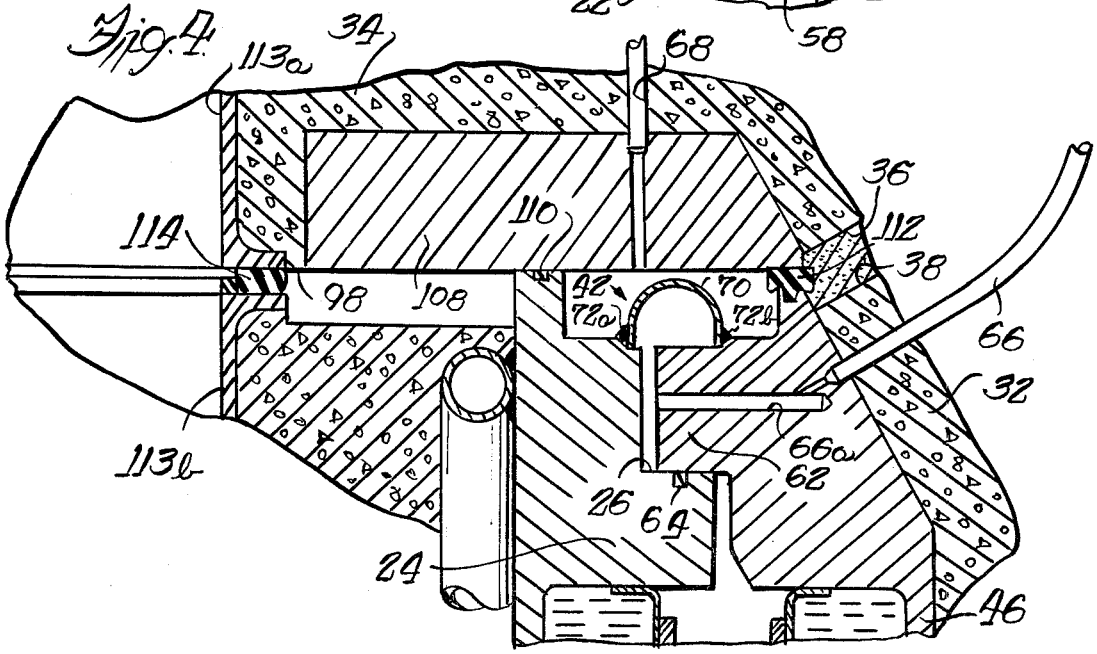
FIG. 4 is an enlarged fragmentary sectional view, taken within the circular section line 4—4 of FIG. 1, showing the omega seal and associated mounting thereof in greater detail.

A metallic penetration liner 22 is provided within the penetration 14 and terminates at its upper end in an annular support collar or flange 24 having an annular shoulder surface 26 formed thereon, as best seen in FIG. 4, the purpose of which will become apparent hereinbelow.

Very generally, and in accordance with the present invention, a closure hold-down system, indicated generally at 30 is operatively associated with the reactor vessel 11 for closing the penetration 14 while permitting selective access to the penetration for repair and replacement of the steam generator or circulating equipment disposed within the penetration 14. The closure hold-down system 30 includes a pressure prestressed concrete closure plug 32 which is supported on the support collar or flange 24 and is adapted to form a leak-tight pressure retaining component of the closure system. The closure plug 32 is retained within the upper end of the penetration 14 by an annular prestressed concrete hold-down or retaining ring 34 which is mounted on the reactor vessel 10 concentric with the closure plug 32 and engages the closure plug through mutually opposed contact surfaces 36 and 38 formed on the hold-down ring 34 and closure plug 32, respectively. The hold-down ring 34 is, in turn, retained in position on the reactor vessel in contacting relation with the closure plug 32 by a plurality of vertical prestressed tendons 40 disposed in equidistantly circumferentially spaced relation about the axis of the hold-down ring. The prestressed tendons 40 pass through the full height of the prestressed concrete reactor vessel 10 and are anchored at the bottom thereof by conventional means such as retaining plates and/or threaded nuts. The tendons 40 maintain the hold-down ring 34 in force equilibrium against the pressure forces exerted on the closure plug 32 from pressures created internally of the penetration 14. Seal means, indicated generally at 42, are provided between the outer circumference of the closure plug 32 and the steam generator liner 14 to prevent leakage of fluid, such as the coolant gas, from internally of the penetration 14 through the annular space between the closure plug and penetration liner.

Turning now to a more detailed description of the closure hold-down system 30, the concrete closure plug 32 is annular in shape and has a generally cylindrical outer configuration. A metallic liner 46 is secured to and extends about the outer cylindrical surface of the closure plug and along a lower or bottom planar surface 48 on the plug. The closure plug 32 may have one or more penetrations extending longitudinally therethrough, such as the illustrated penetration defined by an annular metallic liner **46*a* which may extend from the top of the closure plug downwardly to or below the lower surface 48 of the closure plug as at 46*b*. A plurality of studs 50 are secured to the lower planar portion of liner 46 and extend upwardly into the closure plug 32 from its lower surface 48 so as to secure the liner onto the closure plug. One or more coolant flow tubes 52 may be formed within the closure plug 32 so as to extend in helical or vertical fashion about the closure plug adjacent the inner and outer cylindrical surfaces thereof and in planar relation proximate the lower surface 48. The cooling tubes 52 are preferably provided with connector ends, such as at 52*a*, which are accessible from internally of the hold-down ring 34** for connection to a suitable source of coolant fluid.

Figure 3:
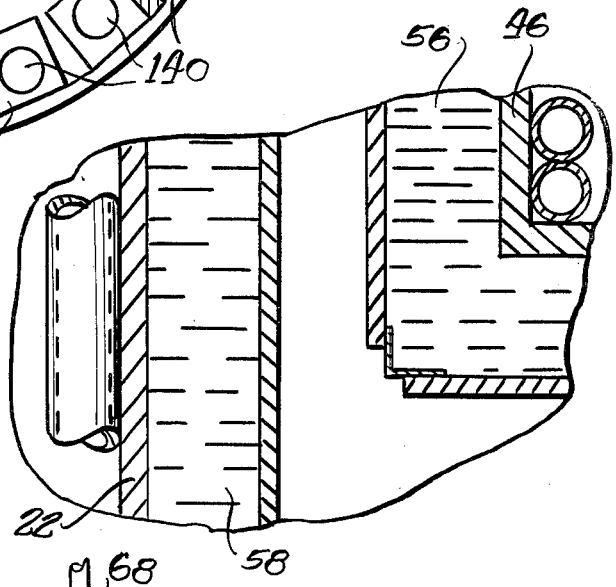
FIG. 3 is an enlarged fragmentary sectional view, taken within circular section line 3—3 of FIG. 1, illustrating the thermal barrier layers interiorly of the penetration liner and externally of the plug liner.

A thermal barrier liner 56 is formed circumferentially about the outer surface of the liner 46, as best seen in FIG. 3, so that the portion of the thermal barrier adjacent the outer annular wall of the liner 46 is spaced from a similar thermal barrier 58 formed on the inner surface of the annular penetration liner 14. The thermal barrier 56 on the closure plug 32 is spaced radially inwardly from the penetration liner 22 and associated thermal barrier 58 sufficiently to allow fluid pressure within the penetration 14 to act on the outer cylindrical surface of the thermal barrier 56 and underlying closure plug 32. This pressure, together with contact of the closure plug with the retaining ring 34, provides the desired pressure prestressing forces on the closure plug.

The outer annular closure plug liner 46 terminates at its upper edge in an annular radial mounting flange 62 adapted for supporting engagement with the shoulder surface 26 on the support flange 24, as best seen in FIG. 4. An elastomer O-ring test seal 64 is received within a suitable annular recess in the support surface 26 so as to be interposed between the shoulder surface 26 and the mounting flange 62. A seal testing fluid pressure tube 66 is formed in the closure plug 32 and intersects an outlet passage **66*a* in the mounting flange 62 to facilitate testing of the seal means 42 between the closure plug and the retaining ring 34. A second seal testing fluid pressure tube 68 is formed in the retaining ring 34 and communicates with the opposite side of the seal means 42** for seal testing purposes.

As aforementioned, the seal means 42 prevents leakage from internally of the penetration through the annular space between the closure plug 32 and the penetration liner 14. The seal means 42 comprises an annular omega seal 70 which, as best seen in FIG. 4, has an inverted U-shaped transverse sectional configuration. The annular concentric edges of the omega seal are suitably secured, as by bimetallic weld beads **72*a* and 72*b*, to the support flange 24 on the penetration liner 14 and to the mounting flange 62 on the closure plug 32, respectively. The welded omega seal 70 is more reliable than metallic O-ring seals as have previously been employed in reactor vessel closure systems and is more effective in withstanding relative deformations between the closure plug 32 and the penetration liner 22. The omega seal 70 may be readily tested by introducing fluid pressure through passage 66, with continuous monitoring during operation being effected through passage 68**.

In addition to closing the open end of the steam generator cavity or penetration 14, the closure plug 32 is adapted to provide support for auxiliary equipment internally of the cavity 14, such as the circulator assembly 16, and may house some minor penetrations. As best seen in FIG. 1, the lower edge of the liner extension **46*b* on the closure plug is formed with a radially inwardly extending flange 74 on which is supported a support tube 76 which forms a part of the coolant circulator 16. The inner liner 46*a* defines a cylindrical axial opening in the closure plug through which a tubular housing 78 may extend for the purpose of receiving a drive line (not shown) for the coolant circulation. The circulator 16**, per se, forms no part of the present invention and will not be described in greater detail herein.

A plurality of minor penetrations may be formed in the closure plug 32, two of which are shown at 82 and 84 in FIG. 1. The minor penetrations may serve to house diffuser valve guides, diffuser valve actuators and instrumentation, as is known.

The closure plug 32 is retained within the open end of the steam generator penetration 14 by the hold-down or retaining ring 34 so that the closure plug forms a fluid-tight pressure retaining component of the closure hold-down system 30. The retainer ring 34 has an annular configuration which, in the illustrated embodiment, has its outer cylindrical surface 88 received within a circular recess 90 in the reactor vessel 11 concentric with the penetration 14. As noted, the retaining ring 34 is made of prestressed concrete which is prestressed by conventional prestressed reinforcing bars (not shown) internally of the retaining ring or circumferential prestressed strands on the outer cylindrical surface 88 of the retaining ring, or both internal reinforcing bars and circumferential prestressed strands. An outer metallic cover 94 is preferably mounted circumferentially on the retaining ring 34 with annular rings 96*a* and 96*b*.

With the retaining ring 34 mounted on the reactor vessel 11 within the recess 90, a lower substantially planar surface 98 on the retaining ring is adapted for supporting relation with an annular lower surface 100 of the recess 90. If desired, the recess 90 need not be provided in the reactor vessel so that the lower surface 98 of the retainer ring 34 rests directly on the uppermost surface of the reator vessel circumferentially of the mouth of the penetration 14. In this case, the liner 14 would extend upwardly to the upper surface of the reactor vessel rather than terminating at lower recessed surface 100 as in the illustrated embodiment. The planar surface 98 terminates at its radial inner edge in the contact surface 36 which, in the preferred embodiment, is inclined upwardly from the plane of surface 98 at an angle of approximately 30° so as to define a frustoconical contact surface. Stated alternatively, an element lying in the frustoconical surface 36 and also in a plane containing the axis of the closure plug subscribes an angle of approximately 60° with the axis of the closure plug. As aforementioned, the contact surface 36 is sized so as to lie in opposed relation to the inclined frustoconical surface 38 formed on the closure plug 32. Any spacing between surfaces 98 and 100 on the retaining ring 34 and reactor vessel 10, respectively, and any spacing between inclined surfaces 36 and 38 on the retaining ring and closure plug 32, respectively, represent spacing resulting from manufacturing tolerances between the closure plug, retaining ring and reactor vessel. Such spaces as may result from manufacturing tolerances are filled with a suitable concrete grouting material to ensure uniform contact between the cooperating elements of the closure hold-down system. The concrete grouting allows relaxation of field assembly tolerances in the assembly of the closure hold-down system. The grouting may be introduced between contact surfaces 98 and 100 through one or more grouting tubes 102 formed vertically through the retaining ring 34. Grouting may be introduced between inclined contact surfaces 36 and 38 from the open area centrally of the retaining ring 34.

As best seen in FIG. 4, an annular mounting plate 108 is embedded within the retaining ring 34 so as to engage the upper edge of the support flange 24 on the penetration liner 22. An elastomer O-ring seal 110 is received within a suitable annular recess in the upper surface of the flange 24 for sealing engagement with the plate 108. The upper edge of the annular flange 62 on the plug liner 46 supports an annular elastomer seal 112 for sealing engagement with the mounting plate 108. The seals 110 and 112 prevent grout from entering the area of the omega seal 70.

The retaining ring 34 is retained against the closure plug 32 by the tendons 40 which are equidistantly circumferentially spaced about the retaining ring and extend vertically through corresponding suitable tubular tendon housings or sleeves 113*a* and 113*b* formed in the retaining ring 34 and reactor vessel 11 so as to permit axial alignment when the retaining ring is mounted on the reactor vessel. As best seen in FIG. 4, an annular elastomer seal 114 is interposed between adjacent ends of the sleeves 113*a, b,* to prevent grout from entering the tendon bores.

In the illustrated embodiment, twenty two tendons 40 extend through the retaininer ring 34 and through the full height of the reactor vessel 10. The tendons 40 are anchored at the bottom of the reactor vessel (not shown) by conventional means so as to axially prestress the tendons. Each tendon has a pressure plate 116 disposed between its head end and the retaining ring 34.

With the closure hold-down system 30 thus described, it can be seen that the pressure forces created within the penetration or cavity 14 and acting on the closure plug 32 are directly transmitted to the prestressed concrete retaining ring 34 and tendons 40 through the frustoconical contact surfaces 36 and 38 and grouting interposed therebetween. The inclined contact surfaces 36 and 38 are effective in reducing the tensile stress in the closure plug 32 resulting from pressure induced rotation of the closure plug. Stated alternatively, the inclined contact surfaces 36 and 38 cooperate to reduce the radial distance or moment arm of the reaction force between the closure plug and retaining ring from the axis of the closure plug, such reaction force being the result of internal pressure within the penetration 14 acting upwardly against the closure plug. This arrangement serves to reduce the reinforcing bar that may be necessary in the closure plug. The radial compressive forces acting on the outer cylindrical surface of the closure plug 32 from the fluid pressure internally of the penetration, in combination with the reaction forces acting on the closure plug by retaining ring 34 through the inclined contact surfces 36 and 38, provide the desired pressure compressive prestress forces on the closure plug.

While a preferred embodiment of the reactor vessel closure hold-down system of the present invention has been illustrated and described, it will be understood to those skilled in the art that changes and modifications may be made therein without departing from the invention in its broader aspects. Various features of the invention are defined in the following claims.

What is claimed is:

1. A closure system for use with a concrete reactor vessel having a cavity in which substantial pressure may be built up internally of the cavity, said reactor vessel defining an open end communicating with said cavity and having a support surface thereon concentric with said open end, an annular liner secured internally of said cavity and defining the outer periphery of said cavity and a substantially annular support flange adjacent said open end of said cavity, said closure comprising, in combination, a concrete closure plug adapted to be received within said open end of said pressure vessel internally of said liner and defining an annular shoulder sized for supporting engagement with said annular support flange, said closure plug spanning said open end of said cavity and having an outer cylindrical surface spaced radially inwardly from said liner so as to define an annular space therebetween having communication with said cavity, and defining an annular load transfer surface thereon facing outwardly from said cavity when said closure plug is supported on said support flange, said closure plug having at least one penetration extending longitudinally therethrough and being adapted to support auxiliary equipment internally of said cavity, an annular prestressed concrete retaining ring defining a first support surface thereon adapted for substantial engagement with said support surface on said reactor vessel in supporting relation therewith, said retaining ring defining an annular retaining surface adapted for substantially direct engagement with said load transfer surface of said closure plug so that pressure forces acting on said closure plug tending to separate said plug from said annular support flange are transmitted directly to said retaining ring through said load transfer surface, a plurality of axially prestressed tendons anchored to said reactor vessel and having direct attaching relation with said retaining ring so as to retain said retaining ring against said support surface of said pressure vessel and establish force equilibrium between said retaining ring and said closure plug from pressures created internally of said cavity, and seal means interposed between said closure plug and said liner so as to prevent outward leakage of fluid pressure therebetween from said cavity but located to enable fluid pressure within said cavity to act radially on said outer cylindrical surface of said closure plug to effect radial compressive forces thereon.

2. A closure system as defined in claim 1 wherein said load transfer surface comprises a frustoconical surface coaxial with the axis of said plug, said retaining surface on said retaining ring being similarly configured for surface engagement with said frustoconical load transfer surface.

3. A closure system as defined in claim 2 wherein an element lying in said frustoconical surface and in a plane containing the axis of said plug subtends an angle of approximately 60° with the axis of said plug.

4. A closure system as defined in claim 1 wherein said axially prestressed tendons extend the full axial length of said pressure vessel through the portion thereof defining said cavity, said tendons extending through said retaining ring and being equidistantly circumferentially spaced about the axis thereof.

5. A closure system as defined in claim 1 wherein said seal means comprises an omega seal having a first annular lip portion secured peripherally to said annular support flange in fluid-tight relation thereon, and having a second annular lip portion concentric with said first lip portion and secured peripherally to said closure plug in fluid-tight relation so that said omega seal prevents escape of fluid pressure between said closure plug and said cavity.

6. A closure system as defined in claim 1 wherein said pressure vessel defines an annular recess having said concentric support surface therein disposed in a plane transverse to the longitudinal axis of said cavity, said retaining ring being adapted to be received within said recess and having its said support surface adapted for engagement with said recess support surface.

7. A closure system as defined in claim 6 including filler grout interposed between said mutually engaging surfaces of said reactor vessel, closure plug and retaining ring sufficient to effect substantially uniform contact between said mutually engaging surfaces.

8. A closure system as defined in claim 1 wherein said retaining ring includes a plurality of prestressed reinforcing strands circumferentially about the outer surface thereof.

9. A closure system as defined in either of claims 1 or 5 including means disposed within said closure plug facilitating pressure testing of said seal means after said closure plug is assembled within said cavity on said support flange.

10. A closure system as defined in claim 1 wherein said closure plug has an external metallic liner thereon defining said annular shoulder.

11. A closure system as defined in claim 1 wherein said closure plug includes means adapted to support auxiliary equipment internally of said cavity.

* * * * *